US012331619B2

(12) United States Patent
Tanner et al.

(10) Patent No.: US 12,331,619 B2
(45) Date of Patent: Jun. 17, 2025

(54) SHAPE MEMORY ALLOY SEAL BLADDER CLAMP RINGS

(71) Applicant: Baker Hughes Oilfield Operations LLC, Houston, TX (US)

(72) Inventors: David Tanner, Broken Arrow, OK (US); Aron Meyer, Pryor, OK (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 156 days.

(21) Appl. No.: 17/736,597

(22) Filed: May 4, 2022

(65) Prior Publication Data

US 2022/0259957 A1 Aug. 18, 2022

Related U.S. Application Data

(63) Continuation-in-part of application No. 16/391,659, filed on Apr. 23, 2019, now abandoned.
(Continued)

(51) Int. Cl.
*E21B 43/12* (2006.01)
*F04D 13/10* (2006.01)
(Continued)

(52) U.S. Cl.
CPC ..... *E21B 43/128* (2013.01); *F04D 13/10* (2013.01); *F04D 29/086* (2013.01); *F04D 29/106* (2013.01)

(58) Field of Classification Search
CPC ..... E21B 43/128; F04D 13/10; F04D 29/086; F04D 29/106
See application file for complete search history.

(56) References Cited

U.S. PATENT DOCUMENTS 3,989,283 A * 11/1976 Pepper ..... F16L 33/32 285/348
6,046,521 A * 4/2000 Heinig ..... H02K 5/132 310/87
(Continued)

FOREIGN PATENT DOCUMENTS

CN 206054733 U 3/2017

OTHER PUBLICATIONS

International Search Report and Written Opinion of PCT Application No. PCT/US2019/028746 dated Aug. 20, 2019: pp. 1-12.
(Continued)

*Primary Examiner* — Philip E Stimpert
(74) *Attorney, Agent, or Firm* — Baker Hughes Company

(57) ABSTRACT

An electrical submersible pump assembly has a seal section housing for coupling between a motor and a pump of the assembly. A bladder has an opening sized to slide over an adapter in the seal section housing. A clamp ring is formed of a shape memory alloy selected to create an expanded condition inner diameter when at a room temperature, enabling the clamp ring to be inserted over the bladder opening during assembly. When heated to a selected elevated temperature, the clamp ring contracts and tightly secures the opening around the adapter. The shape memory alloy of the clamp ring also causes the contracted condition inner diameter to expand when chilled to a selected low temperature. Maximum and minimum diameters of the contracted ring are based on an amount of bladder compression that achieves sealing without damage to the bladder.

8 Claims, 5 Drawing Sheets

Related U.S. Application Data

(60) Provisional application No. 62/662,256, filed on Apr. 25, 2018.

(51) Int. Cl.
*F04D 29/08* (2006.01)
*F04D 29/10* (2006.01)

(56) References Cited

U.S. PATENT DOCUMENTS

| | | | | |
|---|---|---|---|---|
| 6,328,071 | B1 | 12/2001 | Austin | |
| 8,419,387 | B1 | 4/2013 | Karbs et al. | |
| 9,366,120 | B2 | 6/2016 | Merrill et al. | |
| 2008/0222853 | A1 | 9/2008 | Zavattieri et al. | |
| 2009/0206552 | A1 | 8/2009 | Nguy et al. | |
| 2010/0109322 | A1 | 5/2010 | Zavattieri et al. | |
| 2014/0202681 | A1 | 7/2014 | Merrill et al. | |
| 2015/0028168 | A1 | 1/2015 | Morris | |
| 2016/0145963 | A1* | 5/2016 | Flores | E21B 17/00 166/305.1 |
| 2016/0258248 | A1 | 9/2016 | Macdonald | |
| 2017/0030171 | A1 | 2/2017 | Collins | |
| 2017/0261038 | A1 | 9/2017 | Poyyara | |
| 2020/0116000 | A1 | 4/2020 | Parmeter et al. | |

OTHER PUBLICATIONS

U.S. Appl. No. 16/391,659, filed Apr. 23, 2019, Non-Final Office Action dated Aug. 4, 2021.
U.S. Appl. No. 16/391,659, filed Apr. 23, 2019, Final Office Action dated Dec. 8, 2021.

* cited by examiner

SHAPE MEMORY ALLOY SEAL BLADDER CLAMP RINGS

CROSS REFERENCE TO RELATED APPLICATIONS

This application is a continuation-in-part of and claims priority to and the benefit of co-pending U.S. patent application Ser. No. 16/391,659 filed Apr. 23, 2019 and which claimed priority from U.S. Provisional Application Ser. No. 62/662,256, filed Apr. 25, 2018, the full disclosures of which are incorporated by reference herein in their entireties and for all purposes.

BACKGROUND OF THE INVENTION

Field of Invention

This disclosure relates in general to electrical submersible pumps (ESP) for wells and in particular to clamps for a bladder of a pressure equalizer.

Description of Prior Art

Electrical submersible pumps are often used to pump fluids from hydrocarbon wells. An ESP normally includes a motor, a pump, and a pressure equalizer or seal section that reduces a pressure differential between well fluid on the exterior and dielectric lubricant in the motor interior. A typical seal section has a bladder with an interior in fluid communication with the motor lubricant. The bladder may be an elastomeric bag or a metal bellows. Usually, the seal section connects between the motor and the pump.

The bladder has open upper and lower ends. A guide tube extends through the open ends and secures to guides or connectors on the upper and lower ends of the seal section. A drive shaft sealed at the upper connector from well fluid locates within the guide tube. The drive shaft seal is usually a mechanical face seal, which allows slight leakage of well fluid into the upper connector. A well fluid port in the upper connector admits well fluid into the housing exterior of the bladder to exert a pressure force against motor lubricant in the interior of the bladder. It is important to minimize well fluid leakage into the interior of the bladder because it could migrate down to the motor.

There are a number of designs used and known to secure and seal the upper and lower ends to the upper and lower connectors. Typically, clamps secure the bladder ends to adapter portions of the connectors. The clamps are basically hose clamps that are tightened manually to exert forces on the bladder ends against the adapters. A technician mechanically locks each clamp to maintain a pre-load force on the bladder ends.

Although successful, sometimes bladder ends develop leaks because of an insufficient clamping force during the initial assembly. The insufficient clamping force can be due to deficiencies in the mechanical retention mechanism. It can also be due to an inherent discontinuity in the clamp need to allow for slippage so that a changed in diameter can be applied. The discontinuity creates an area of lower or higher pressure that can lead to leaks or tears. Further, in an attempt to ensure the pressure exerted onto the bladder is adequate to avoid leakage, an excessive amount of stress is applied by the clamps that damages the bladder. Also, at times, an operator may shut down an installed ESP, causing the ESP to cool until re-started again. The different expansion and contraction of the materials during thermal cycling can create forces that exceed the material properties of the clamps, causing the clamps to loosen.

SUMMARY OF THE INVENTION

An electrical submersible pump assembly has a seal section housing for coupling between a motor and a pump of the assembly. The housing has a longitudinal axis and first and second adapters axially spaced apart and extending toward each other from first and second ends of the housing, respectively. Each of the first and second adapters has an outward facing annular wall relative to the axis. A bladder has first and second openings on first and second ends, respectively, that insert over the first and second adapters, respectively. A first clamp ring has an expanded condition that enables the first clamp ring to be inserted over the first opening and the first opening to be inserted over the annular wall of the first adapter. The first clamp ring has a contracted condition that tightly secures the first opening to the annular wall of the first adapter. The first clamp ring is formed of a shape memory alloy that causes movement from the expanded condition to the contracted condition in response to heating the first clamp ring to a selected elevated temperature.

The selected elevated temperature required to cause the first clamp ring to move from the expanded condition toward the contracted condition is at least 50 degrees C. and may be in a range from 50 degrees C. to 165 degrees C.

The first clamp ring is movable from the contracted condition back to the expanded condition in response to chilling the first clamp ring to a selected low temperature. The first clamp ring remains in the expanded condition after being warmed from the selected low temperature to a room temperature. The selected low temperature may be between minus 55 degrees C. and minus 120 degrees C.

The first clamp ring may a solid annular member with a weld that welds opposite ends of the first clamp ring together.

The shape memory alloy causes the first clamp ring to remain in the contracted condition after reaching the selected elevated temperature until the first clamp ring is chilled to at least minus 55 degrees C.

The first clamp ring has an inner diameter that can be contracted only by heating to the selected elevated temperature.

In a transverse cross-sectional view, the first clamp ring has a round configuration.

A second clamp ring may extend around the second opening. The second clamp ring has an expanded condition that enables the second clamp ring to be inserted over the second opening during assembly. The second clamp ring has a contracted condition that tightly secures the second opening to the annular wall of the second adapter. The second clamp ring may be formed of the same shape memory alloy as the first clamp ring.

BRIEF DESCRIPTION OF DRAWINGS

So that the manner in which the features, advantages and objects of the disclosure, as well as others which will become apparent, are attained and can be understood in more detail, more particular description of the disclosure briefly summarized above may be had by reference to the embodiment thereof which is illustrated in the appended drawings, which drawings form a part of this specification. It is to be noted, however, that the drawings illustrate only a preferred embodiment of the disclosure and is therefore not to be considered limiting of its scope as the disclosure may admit to other equally effective embodiments.

DETAILED DESCRIPTION OF INVENTION

Figure 1:
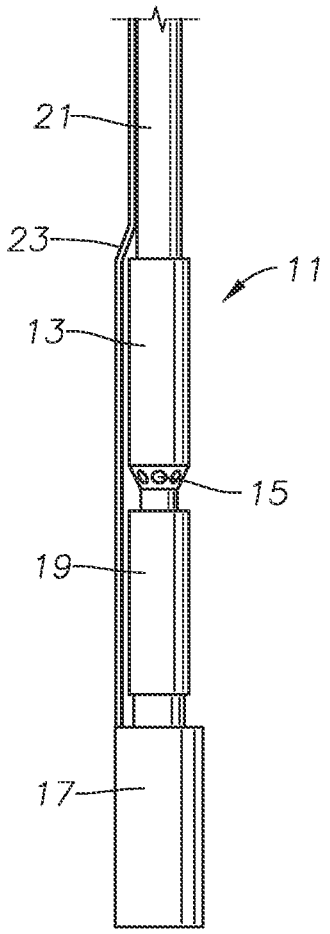
FIG. 1 is a schematic view of an ESP having a pressure equalizer or seal section in accordance with this disclosure.

The methods and systems of the present disclosure will now be described more fully hereinafter with reference to the accompanying drawings in which embodiments are shown. The methods and systems of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, ESP 11 includes a pump 13 having an intake 15. If a gas separator is employed below pump 13, intake 15 would be in the gas separator. Pump 13 may be a centrifugal pump or another type, such as a progressing cavity pump or a linear, reciprocating pump. A motor 17 couples to a shaft in pump 13 for driving pump 13. A dielectric lubricant in motor 17 lubricates the bearings within the motor. A seal section or pressure equalizer 19 couples to motor 17 to reduce a pressure differential between exterior well fluid and the dielectric lubricant. In this example, seal section 19 connects between motor 17 and pump intake 15.

A string of production tubing 21 secures to the upper end of pump 13, supporting pump 13 in a well. Production tubing 21 may be joints of tubular members with threaded ends secured together. Pump 13 discharges well fluid into the interior of production tubing 21. A power cable 23 extends alongside production tubing 21 to motor 17. Alternately, a string of continuous coiled tubing may support ESP 11 in the well. In that instance, pump 13 would discharge well fluid into the annulus surrounding the coiled tubing. The power cable would extend through the interior of the coiled tubing.

Figure 2:
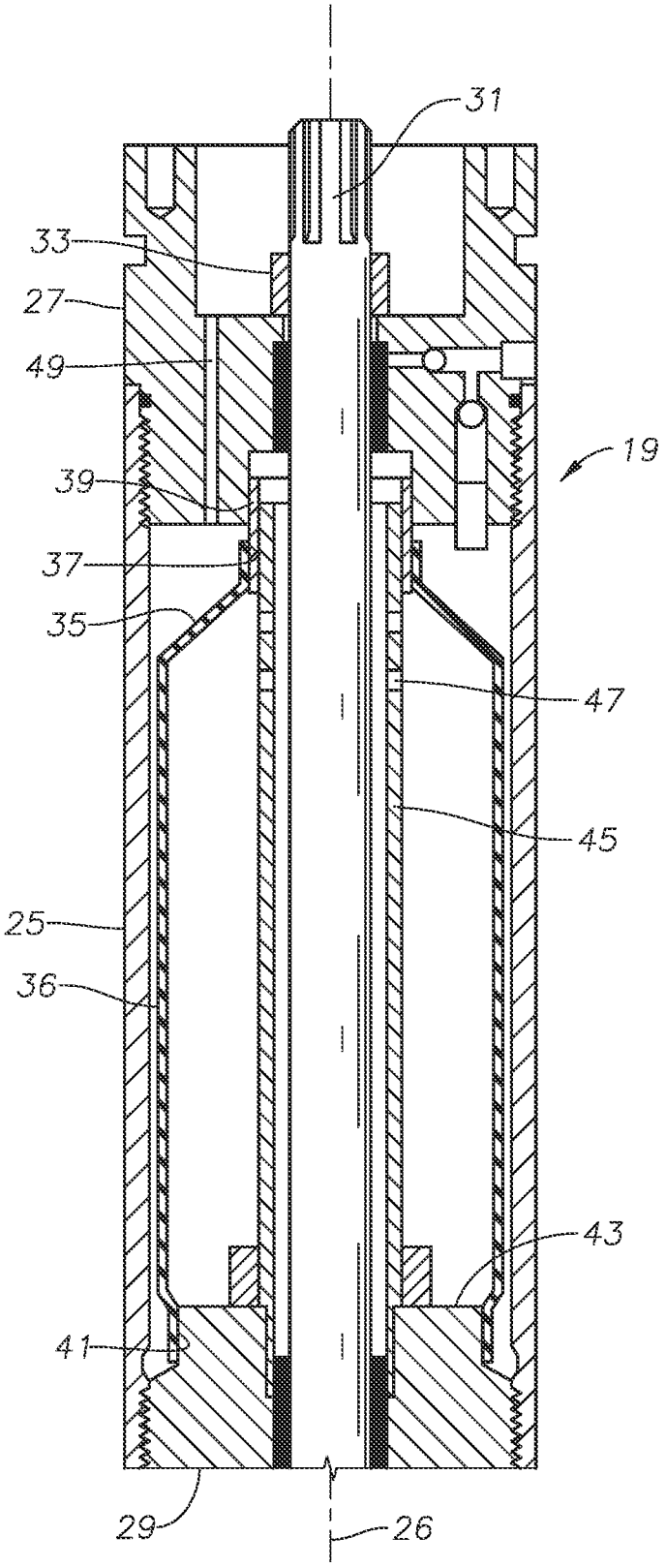
FIG. 2 is a sectional view of an upper portion of the seal section of FIG. 2.

FIG. 2 shows an upper portion of seal section 19, including a tubing housing 25 with a longitudinal axis 26. An upper connector or head 27 secures to the upper end of housing 25 and connects seal section 13 to pump intake 15 (FIG. 1). A lower connector or guide 29 secures to the lower end of housing 25. In this example, lower connector 29 secures to one or more additional portions of seal section 13. The additional portions may have components similar to that in the upper portion, or the additional portions may have labyrinth tubes and other components. The terms "upper", "lower" and the like are used only for convenience as ESP 11 may operate in inclined, horizontal and inverted positions.

A rotatable drive shaft 31 extends through bearings within upper and lower connectors 27, 29. Motor 17 (FIG. 1) rotates drive shaft 31, which in turn drives pump 13 (FIG. 1). A shaft seal 33 on the upper end of drive shaft 31 seals against leakage of well fluid into the passage in upper connector 27 through which drive shaft 31 extends. Shaft seal 33 is typically a mechanical face type of seal.

A flexible element or bladder 35 has an upper opening 37 on its upper end that secures to an upper adapter 39. In this example, bladder 35 is a tubular member having an outer cylindrical wall 36, and it may be formed of many different types of elastomeric materials. Upper opening 37 comprises a tubular neck protruding upward from cylindrical wall 36 that has a smaller diameter than cylindrical wall 36. Upper adapter 39 has a cylindrical outward facing wall that receives the inner diameter of upper opening 37. Upper adapter 39 may be a tubular member secured to upper connector 27, or it could be integrally formed with upper connector 27.

Bladder 35 has a lower opening 41 on its lower end that secures to a lower adapter 43. Lower opening 41 may be considered to be a tubular neck protruding downward from bladder wall 36. Lower opening 41 may have a smaller diameter than outer cylindrical wall 36. In this example, lower opening 41 has a larger inner diameter than upper opening 37, but that could differ. Lower adapter 43 is an integral upper portion of lower connector 29 in this example. Lower adapter 43 could alternately be a separate component secured to lower connector 29. Lower adapter 43 has a cylindrical outward facing wall that receives the inner diameter of lower opening 41.

A rigid guide tube 45 extends through bladder 35 between upper and lower adapters 39, 43. Each adapter 39, 43 could alternately be secured to guide tube 45 rather than forming part of or attaching to one of the upper and lower connectors 27, 29. Guide tube 45 has a larger inner diameter than the outer diameter of drive shaft 31, defining an inner annulus. Guide tube ports 47 in guide tube 45 near its upper end communicate the inner annulus with the interior of bladder 35. Motor lubricant from motor 17 communicates with the inner annulus between guide tube 45 and drive shaft 31. The motor lubricant communicates with the interior of bladder 35 via guide tube ports 47. A well fluid port 49 in upper connector 27 admits well fluid into housing 25 on the exterior of bladder 35.

Figure 3:
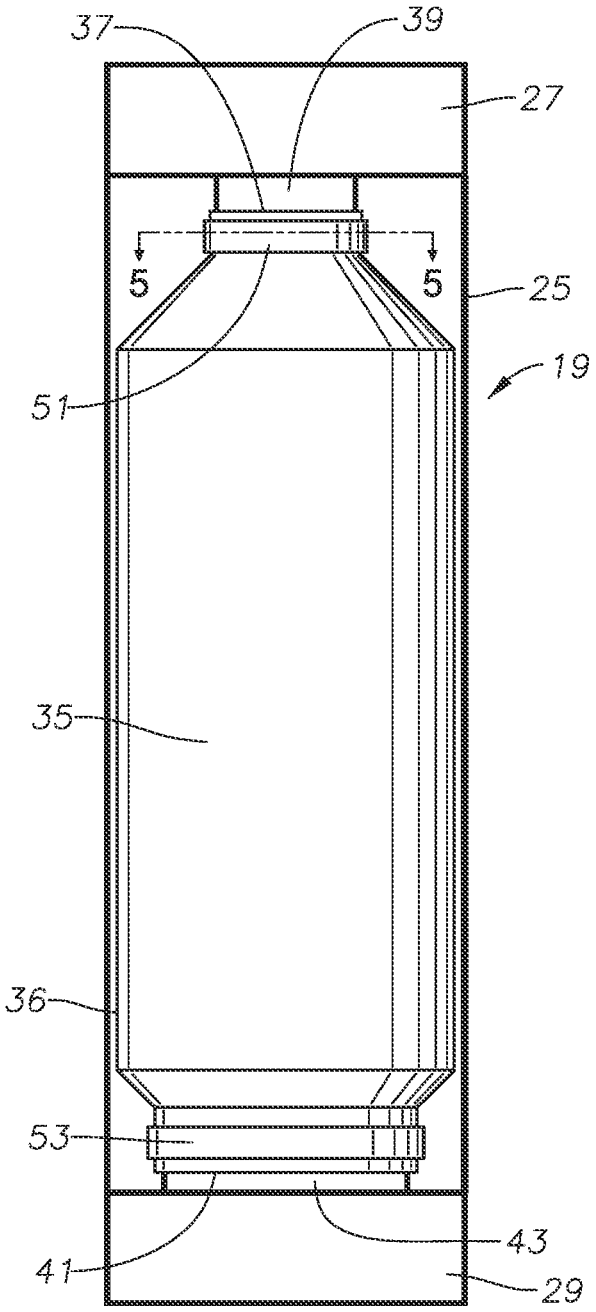
FIG. 3 is a schematic view of the bladder and clamp rings of the seal section of FIG. 2.

Referring to FIG. 3, an upper clamp ring 51 secures bladder upper opening 37 to upper adapter 39. A lower clamp ring 53 secures bladder lower opening 41 to lower adapter 43. Upper and lower clamp rings 51, 53 may be the same, except in this example, lower clamp ring 53 has a larger inner diameter than upper clamp ring 51. Upper and lower clamp rings 51, 53 may be cylindrical annular members, as shown, or they could be round rods or wires, circular in transverses cross section as shown inn FIGS. 8 and 9. Upper clamp ring 51 encircles the outer diameter of upper opening 37 of bladder 35 and exerts a clamping force, sealing upper opening 37 around the outward facing cylindrical wall of upper adapter 39. Similarly, lower clamp ring 53 encircles the outer diameter of lower opening 41 and exerts a clamping force, sealing lower opening 41 around the outward facing cylindrical wall of lower adapter 43.

Figure 4:
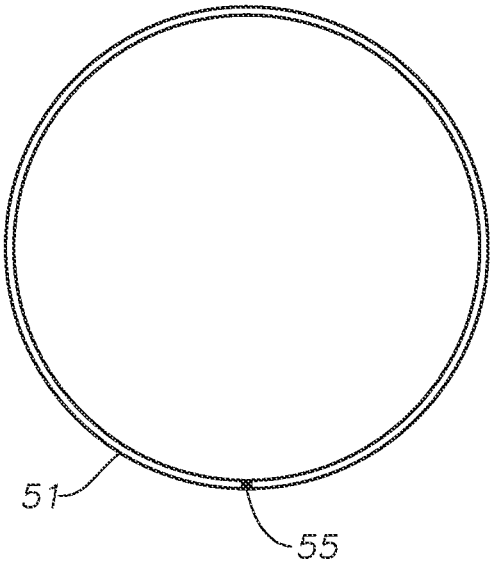
FIG. 4 is an elevational view of the upper clamp ring of FIG. 3, shown removed from the seal section.
Figure 5:
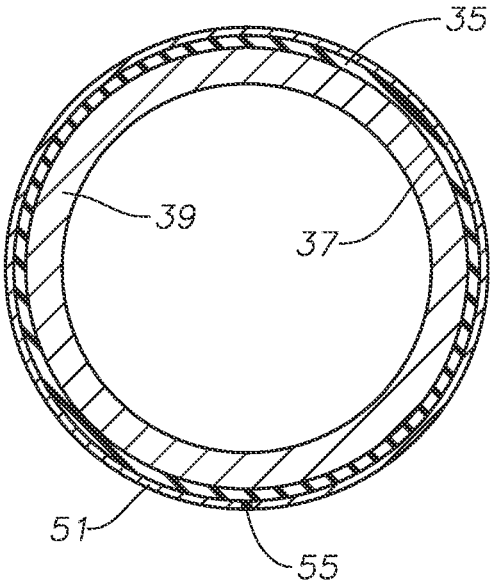
FIG. 5 is a sectional view of the bladder and upper clamp ring of FIG. 3, taken along the line 5-5 of FIG. 3.
Figure 6:
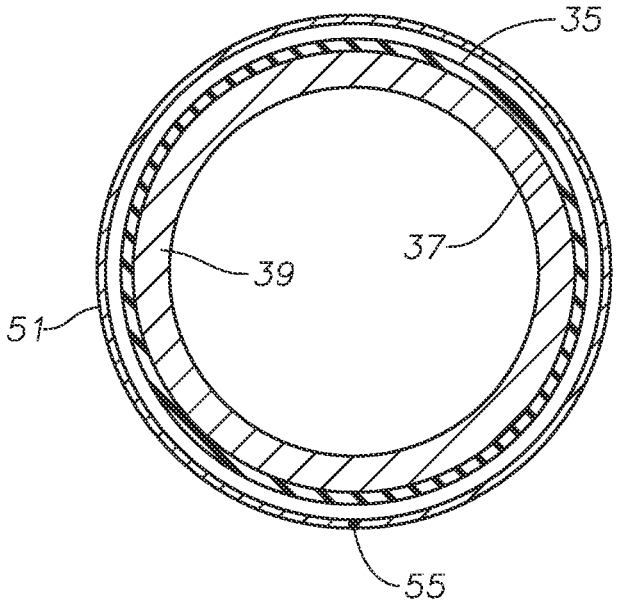
FIG. 6 is sectional view similar to FIG. 5, but showing the upper clamp ring in an expanded condition.

FIGS. 4-7 illustrate upper clamp ring 51; lower clamp ring 53 may be the same, except for the diameter, thus it is not shown. The following discussion concerning upper clamp ring 51 is also applicable to lower clamp ring 53. As shown in FIG. 4, upper clamp ring 51 is a solid, continuous or endless annular member. In this embodiment, upper clamp ring 51 is an annular band and when viewed in a transverse cross-section it would appear rectangular with a width thinner than an axial dimension. Upper clamp ring 51 may be formed by bending a strip of metal into a circular shape and welding the two ends together with a weld 55, as shown. Weld 55 may be a butt weld ground smooth and heat treated. Weld 55 will have the same metallurgy as the remaining portions of upper clamp ring 51. Alternately, rather than a weld, upper clamp ring 51 may be formed from a drawn seamless tube.

The material of upper clamp ring 51, including weld 55, if employed, is a shape memory ("SMA") alloy. The SMA alloy of upper clamp ring 51 provides upper clamp ring 51 with the ability to contract from an expanded condition (FIG. 6) to a contracted condition (FIG. 5) in response to the application of a selected elevated temperature. In the expanded condition, the inner diameter of upper clamp ring 51 is larger than while in the contracted condition. While in the expanded condition, the inner diameter of upper clamp ring 51 will be the same or slightly greater than the outer diameter of upper opening 37, enabling a technician to slide upper clamp ring 51 loosely over upper opening 37. In the contracted condition the inner diameter of upper clamp ring 51 is less than the initial outer diameter of upper opening 37. The inner diameter while in the contracted condition is selected to exert a desired level of a radially inward directed compressive force on bladder upper opening 37, sealing it to upper adapter 39.

After reaching the contracted condition, upper clamp ring 51 will precisely hold its contracted inner diameter stable even if the temperature is subsequently lowered or increased from the selected high temperature during well pumping operations. Upper clamp ring 51 will hold the contracted position once achieved because of a metallurgical phase change that occurs while heating upper clamp ring 51 when it is in the expanded condition to the selected elevated temperature.

Also, the SMA material of upper clamp ring 51 may have the ability to undergo an expansion from its contracted condition back to its expanded condition if a sufficiently cold temperature is applied to upper clamp ring 51. Preferably, upper clamp ring 51 will undergo another phase change at a selected low temperature, causing upper clamp ring 51 to expand back to and retain its expanded condition. The low temperature phase change causes upper clamp ring 51 to retain the expanded condition after the low temperature is removed. Upper clamp ring 51 will hold the expanded condition until reheated to the selected high temperature. This characteristic of the SMA material enables clamp ring 51 to be installed and subsequently removed by a technician while at room temperature of 20-25 degrees C.

The selected low temperature is far below any temperature that upper clamp ring 51 would normally experience while ESP 11 is operating or while ESP 11 is out of a well, even in artic regions. Allowing a return of upper clamp ring 51 from the contracted position to the expanded position allows a technician to remove upper clamp ring 51 from bladder upper opening 37 to dissemble seal section 19 after ESP 11 has been pulled from a well. The technician may then reuse upper clamp ring 51 with a new bladder 35.

During manufacturing of upper clamp ring 51, a designer will specify a desired inner diameter while in the contracted condition, such as 3.8 inches, and a desired inner diameter while in the expanded condition, such as 4.0 inches. That difference makes the change between the metallurgical state while expanded and the metallurgical state while contracted at about 5%.

One suitable SMA alloy that will achieve and hold the expanded and contracted conditions includes 38% Titanium, 48% nickel, and 14% Niobium. This material will undergo a complete phase change to place upper clamp ring 51 in the contracted condition when heated from room temperature to about 165 degrees C. This material will undergo another phase change to return upper clamp ring 51 from the contracted condition to the expanded condition when chilled from room temperature to about minus 120 degrees C.

The manufacturer will manufacture upper clamp ring 51 to the expanded condition. A technician slides upper clamp ring 51 around bladder upper opening 37 and slides bladder upper opening 37 over upper adapter 39 while at room temperature. The technician then applies heat to upper clamp ring 51 in an amount to reach the selected high temperature that causes the phase change to place upper clamp ring 51 in the contracted position. The selected high temperature should not be high enough to cause damage to the material of bladder 35. The SMA alloy mentioned above will reach the contracted condition once heated to the selected high temperature of about 165 degrees C., although it will begin to change phase once it reaches about 50 degrees C. Once the phase has fully changed at 165 degrees C., upper clamp ring 51 will remain in the contracted condition even if ESP 11 operational temperatures are higher and lower. In some wells during operation of ESP 11, upper clamp ring 51 could reach temperatures higher than the selected high temperature of 165 degrees C.

The SMA alloy material mentioned above will cause a phase change to return to the expanded condition only when chilled to its selected low temperature of about minus 120 degrees C., which is far below any temperatures that ESP 11 would ordinarily experience. The phase change may begin at about minus 55 degrees C.

Figure 7:
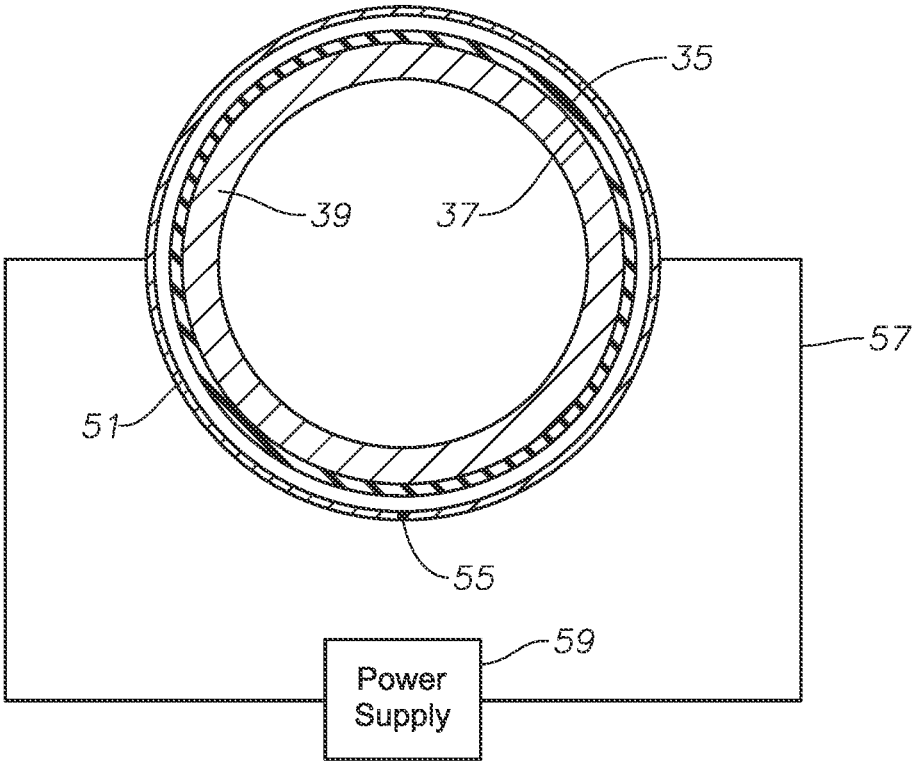
FIG. 7 is a schematic sectional view similar to FIG. 6, but showing electrical current being applied to the upper clamp ring to heat it.

One way to heat upper clamp ring 51 after it has been placed around bladder upper opening 37 would be to place the assembly in an oven. FIG. 7 illustrates another way, which involves passing an electrical current through upper clamp ring 51 after it is placed around bladder upper opening 37. The SMA alloy mentioned above has a resistance that is sufficient to cause heating when an electrical current passes through it, the resistivity being about 35 times ten to the minus 6 power ohms per inch. The technician connects power leads 57 of opposite polarity to opposite sides of upper clamp ring 51, 180 degrees apart from each other. The power leads 57 connect to a power supply 59. The technician causes power supply 59 to supply a fairly high current at a low voltage through leads 57 to upper clamp ring 51. For example, the current may be 25 to 300 amps at less than 10 volts. The electrical current will cause upper clamp ring 51 to reach the desired high temperature, which may be 165 degrees C.

After ESP 11 has experienced its run life and is retrieved, a technician may then cause upper clamp ring 51 to expand to its expanded condition in order to remove upper clamp ring 51 from bladder 35. The technician may accomplish this step by chilling upper clamp ring 51 to its selected phase change low temperature. The technician may chill upper clamp ring 51 by dipping it into liquid nitrogen. At least part of upper adapter 39 and bladder 35 may also be chilled during this dipping process. After reaching the selected low temperature, upper clamp ring 51 will move back to the expanded condition. The expanded condition will remain after upper clamp ring 51 warms from the selected low temperature, enabling a technician to remove upper clamp ring 51 from bladder 39 while at room temperature. On re-installation of upper clamp ring 51, heating clamp ring 51 to the selected high temperature will again return the same upper clamp ring 51 to the contracted position. Upper adapter 39 may be re-usable as well as upper clamp ring 51. Bladder 35 is ordinarily not re-used.

Figure 8:
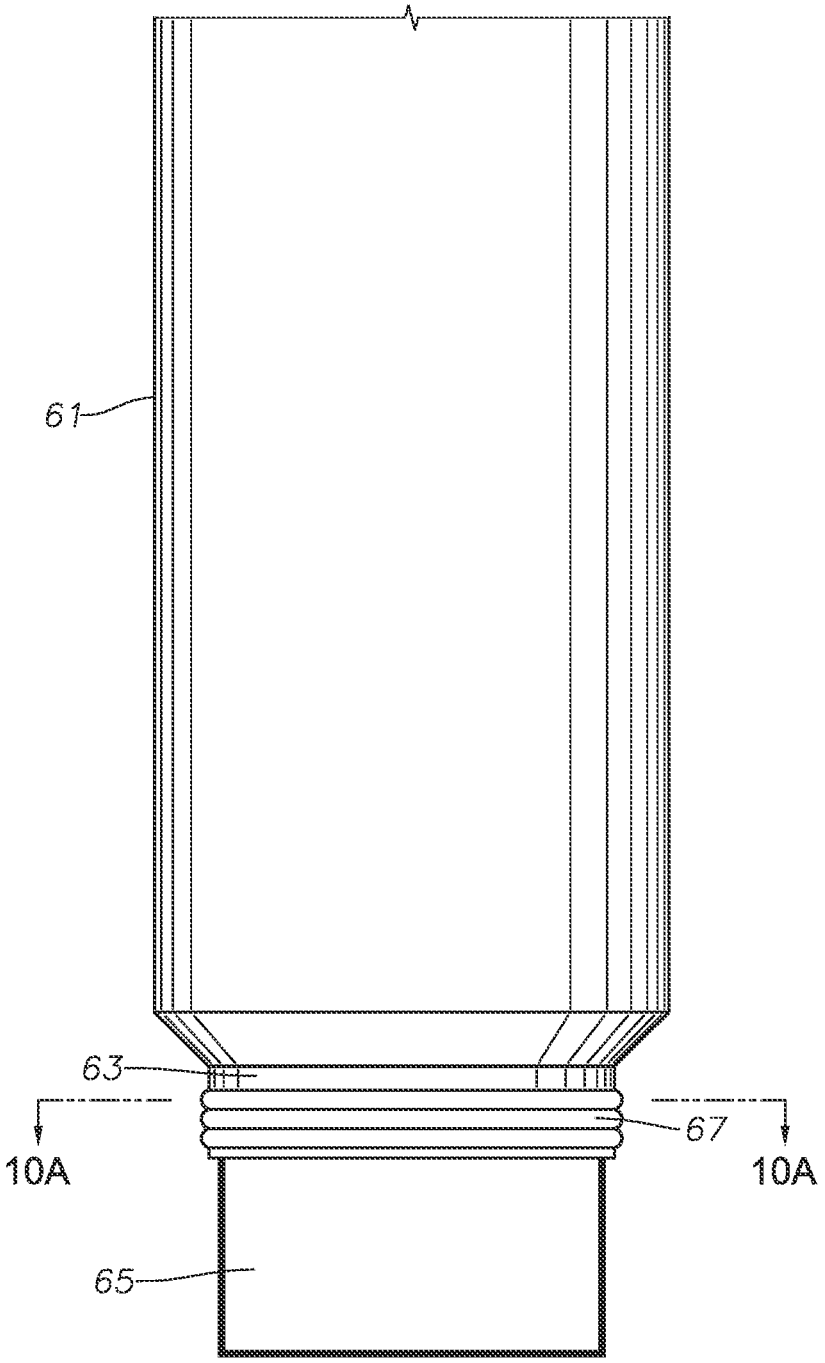
FIG. 8 is a schematic view of an alternate embodiment of a bladder and clamp rings.
Figure 9:
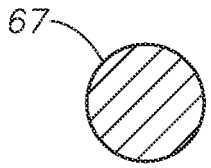
FIG. 9 is a transverse cross-sectional view of one of the clamp rings of FIG. 8.

FIGS. 8 and 9 illustrate a second embodiment. FIG. 8 shows only the lower portion of a bladder 61. Bladder 61 is elastomeric and may be the same as bladder 35 of the first embodiment. Bladder 61 has a lower opening 63 that slides over a lower adapter 65 and is secured by one or more lower clamp rings 67 (three shown). Lower clamp rings 67 are formed of a shape memory alloy, which may be the same as in the first embodiment. In the example shown each lower clamp ring 67 is a wire with a round exterior in transverse cross-section. As in the first embodiment, each lower clamp ring 67 optionally has ends that are welded together, or alternatively is formed as a continuous hoop.

Similar to the first embodiment clamp rings 67 have expanded conditions that enable them to slide over a neck portion of bladder 61 around opening 63 while at room temperature. Subsequently, clamp rings 67 are heated to a selected elevated temperature, which causes them to contract and tightly secure lower opening 63 around lower adapter 65. In an example of removal, lower clamp rings 67 are chilled to a selected low temperature causing a phase change in the material so the rings 67 return to the expanded condition. Clamp rings 67 will remain in the expanded condition until again heated to the selected elevated temperature.

As in the first embodiment, the inner diameters of clamp rings 67 change in response to heating to the selected elevated temperature and chilling to the selected low temperature. Bladder 61 optionally has an upper opening (not shown) that secures over an upper adapter with upper clamp rings formed of a shape memory alloy and having round transverse cross-sectional shapes.

Figure 10A:
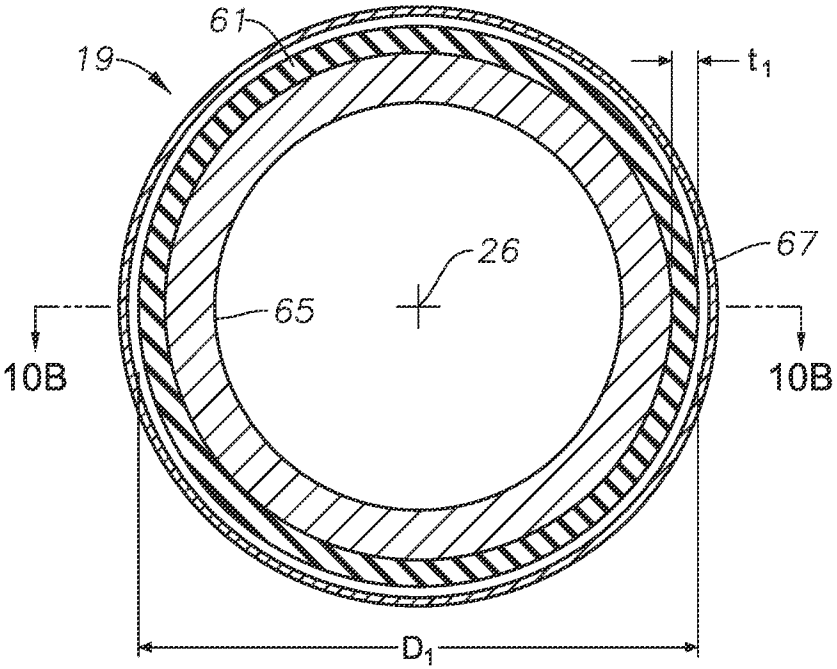
FIG. 10A is an axial sectional view of the embodiment of FIG. 8 taken along lines 10A-10A.

Illustrated in FIGS. 10A/B and 11A/B in an embodiment of selecting and/or designing a clamp ring 67 that includes considering how the material making up the bladder 61 responds to an applied compressive force. In this embodiment, design of the ring 67 is based on an amount or a range of amounts of compression of the bladder 61 to achieve sealing between the bladder 61 and adapter 65, and also the amount of compression allowable without causing damage to the bladder 61. In an example, design of the ring 67 includes selection of the material making up the ring 67. Referring specifically to FIG. 10A, shown is an initial step of assembling seal section 19 in which an end of bladder 61 is slid over retainer 65 and clamp ring 67 circumscribes bladder 61. In the example shown and during the initial assembly step, the clamp ring 67 is in the expanded or supplied condition; in the expanded condition the clamp ring 67 is dimensioned to circumscribe an end of bladder 61 that is installed over retainer 65, and without compressing bladder 61. Shown in FIGS. 10A/B inner circumference of clamp ring 67 is spaced away from an outer surface of bladder 61, alternatives exist in which ring 67 is in sliding contact with the outer surface of bladder 61. A single clamp ring 67 is shown in this example. Alternatives include additional clamp rings 67, which optionally are set adjacent one another around the bladder 61; or spaced apart at designated distances, embodiments of which include one of more of equidistant distances, staggered distances, and combinations.

Figure 10B:
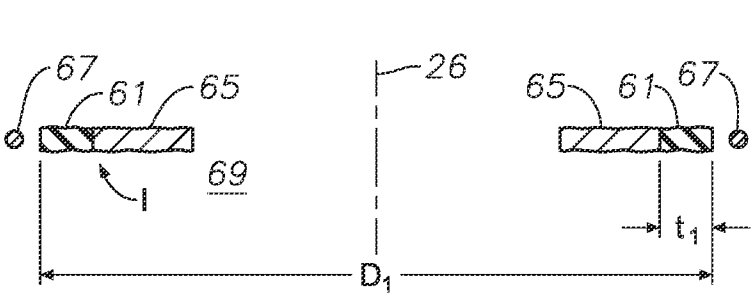
FIG. 10B is a transverse sectional view of the bladder, clamp, and adapter and taken along lines 10B-10B of FIG. 10A.

A chamber 69 is defined within bladder 61 for retaining motor lubricant. Further in this example, the bladder 61 is in an uncompressed state and having a sidewall with an unconfined radial thickness $t_1$ and unconfined diameter $D_1$. In an example of operation pressure within chamber 69 exceeds a force per unit area along interface I between bladder 61 and adapter 65 so that along interface I a barrier is not present to retain motor lubricant inside chamber 69. In the embodiment shown in FIG. 10B, an example of a force per unit area along interface I is a result of tension in the end of bladder 61 created by inserting adapter 65 into bladder 61 when there is little to no clearance between outer and inner respective diameters of adapter 65 and bladder 61.

Figure 11A:
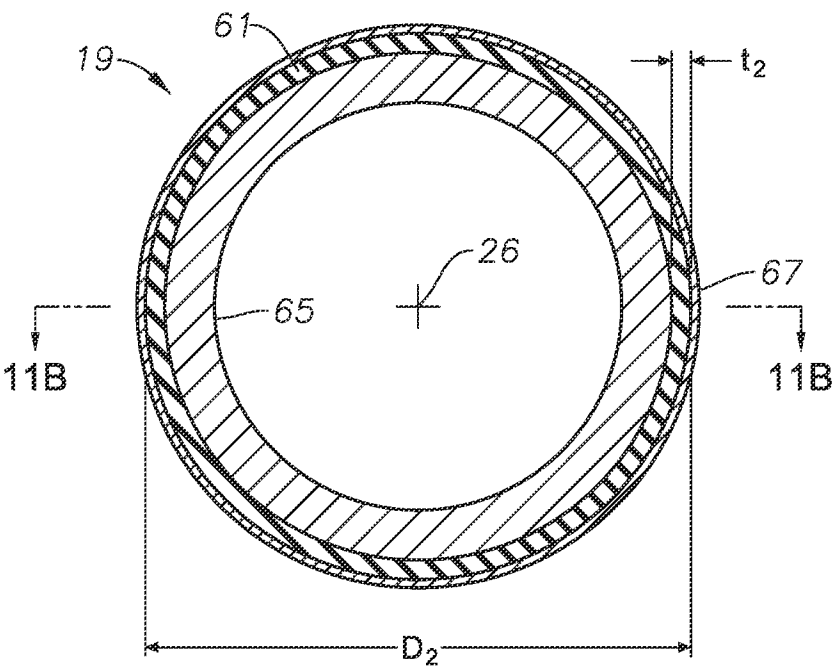
FIG. 11A is an axial sectional view of the embodiment of FIG. 10A with the clamp in a contracted state.
Figure 11B:
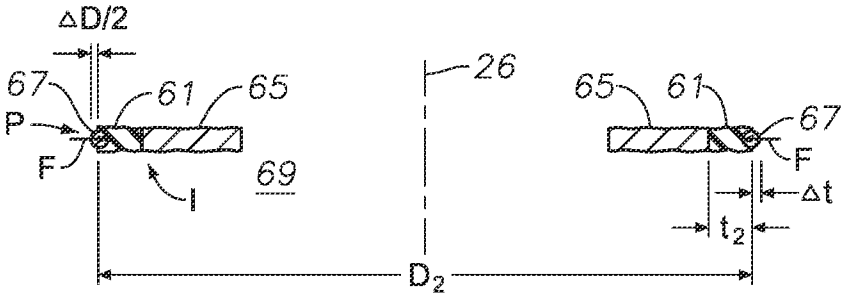
FIG. 11B is a transverse sectional view of the bladder, clamp, and adapter and taken along lines 11B-11B of FIG. 11A.

A subsequent step of assembling seal section 19 is shown in FIGS. 11A and 11B. As shown a clamp ring 67 is transformed into a contracted condition, such as by the temperature induced phase transformation discussed above. In the contracted condition of FIGS. 11A and 11B clamp ring 67 impinges radially inwardly against a portion P of the outer surface of bladder 61 to compress that portion P of bladder 61. Along the portion P and when compressed, the diameter and thickness of bladder 61 changes from an unconfined diameter $D_1$ and unconfined radial thickness $t_1$ to a confined diameter $D_2$ and confined radial thickness $t_2$. Illustrated in the example of FIG. 11B is that transformation of the clamp ring 67 from its expanded to contracted state generates an amount of compression of the bladder 61. The amount of compression is further illustrated by a difference between diameters $D_1$ and $D_2$ and referred to herein as $\Delta D$, and compression across a sidewall of the bladder 61 is shown as $\Delta D/2$. Alternatively, the amount of compression is illustrated by a difference between thicknesses $t_1$ and $t_2$, as represented by $\Delta t$. In an alternative, the amount of compression is referred to as a "squeeze percent", which is equal to one-half the difference between the bladder portion P outer diameter when compressed, and inner diameter of ring 67 when in the contracted or recovered condition. Further in this example, the amount of compression of the portion P generates a resultant force F inside the portion P, as represented by arrow in the direction of adapter 65, and increases the force per unit area along interface I from when portion P is unconfined. In an embodiment, a resultant force F is referred to as a sealing force F when the resultant force F generates a force per unit area along interface I sufficient to form a barrier along interface I to block motor lubricant from escaping chamber 69 across interface I. Further in this embodiment, an amount of compression in the bladder 61 that results in a sealing force F to exist along interface I is referred to as a sealing amount of compression. The outer diameter of portion P is referred to as $D_{MAX}$ when the amount of compression in the bladder 61 creates the sealing amount of compression. In an example the force per unit area resulting from sealing force F is equal to pressure in chamber 69, and in an alternative this force per unit area exceeds pressure in chamber 69. The outer diameter of portion P is referred to as $D_{MIN}$ when the amount of compression in the bladder 61 is at an amount that damages the material in the bladder 61. Examples of damage include fracture, shearing, a tear, a reduction or loss of elasticity, and combinations. In a non-limiting example of operation, a ring 67 is designed to contract at least by an amount so its diameter when in the contracted state is at $D_{MAX}$ or less to ensure a sealing force F is at least equal to pressure in chamber. Included in this example is that when in the contracted state the diameter of the ring 67 is at or greater than $D_{MIN}$ to avoid damaging the bladder 61. As noted above values for $D_{MAX}$ and $D_{MIN}$ are based on properties of the material making up the bladder 61, and where values for $D_{MAX}$ and $D_{MIN}$ are obtained by subtracting the amount of compression in the bladder 61 from the uncontracted or supplied diameter of the ring 67. A relationship between an amount of compression of material of bladder 61 and a resulting force per unit area along interface I is dependent on a modulus of elasticity of the material making up the bladder 61; and similarly, the maximum amount of compression allowed without damaging the material of the bladder 61 is determinable based on a tensile strength of the material. It is within the capabilities of those of ordinary skill in the art to determine an amount of compression that results in a sealing force F, and an amount of compression that damages the material.

In a non-limiting example of selecting/designing a clamp ring 67 based on a bladder material, given values include an outer diameter of portion P when installed (such as when inserted onto retainer 65), an unconfined thickness of portion P, and properties of material making up bladder 61 (such as but not limited to elastic modulus and tensile strength). Based on the bladder 67 material properties, unconfined thickness of portion P, and outer diameter of portion P values for $D_{MAX}$ and $D_{MIN}$ are determinable. Further in this example, design criteria are established for the ring 67 that when in the expanded condition its inner diameter $ID_{EXP}$ be at least as great as the outer diameter of the bladder 61 when mounted on the adapter 65; and when in the contracted condition, the inner diameter $ID_{CON}$ of the clamp ring 67 be between $D_{MAX}$ and $D_{MIN}$. In an example of selecting a material for the clamp ring 67 a shaped memory alloy is identified that has an anticipated phase change to cause a dimensional percent change that is between $ID_{EXP}/D_{MAX}$ and $ID_{EXP}/D_{MIN}$.

In alternatives, design and/or formation of a clamp ring includes those having rectangular transverse cross-sections, such as the clamp ring 51 discussed above; as well as clamp rings formed from materials other than shaped memory alloys.

While the disclosure has been shown in only two of its forms, it should be apparent to those skilled in the art that it is not so limited, but is susceptible to various changes without departing from the scope of the claims.

What is claimed is:

1. A method of handling an electrical submersible pump assembly ("ESP") comprising:

installing an open end of a bladder over an annular adapter that is provided in a seal section of the ESP;

defining an outer diameter of the open end of the bladder to be $D_{MAX}$ when the open end of the bladder is compressed against the annular adapter by a sealing force that forms a barrier to fluid communication between the open end of the bladder and the adapter;

defining the outer diameter of the open end of the bladder to be $D_{MIN}$ when the open end of the bladder is compressed against the adapter by an amount that damages the open end of the bladder;

forming a clamp ring that comprises a shape memory alloy and has an inner diameter at least as great as an outer diameter of the open end of the bladder when in an uncompressed configuration and installed over the adapter;

installing the clamp ring over an end of the bladder;

securing the end of the bladder to the adapter by heating the clamp ring to a selected high temperature that causes a phase change to place the clamp ring in a contracted position that exerts a desired level of a radially inward directed compressive force to compress the open end of the bladder to have an outer diameter that is between $D_{MIN}$ and $D_{MAX}$, which applies the sealing force forming the barrier to fluid communication between the open end of the bladder and the adapter;

operating the ESP in a well;

retrieving the ESP from the well;

expanding the clamp ring by chilling the clamp ring to a selected low temperature that is below that experienced by the clamp ring while the ESP is operating in the well and while the ESP is out of the well; and removing the clamp ring from the open end of the bladder.

2. The method of claim 1, further comprising replacing the bladder with a new bladder, and reusing the clamp ring with the new bladder.

3. The method of claim 1, wherein the clamp ring is received from a manufacturer in an expanded condition.

4. The method of claim 3 further comprising placing the clamp ring over the end of the bladder in the expanded condition.

5. The method of claim 4, wherein the clamp ring is at room temperature when placed over the end of the bladder.

6. The method of claim 5, further comprising changing the clamp ring into the contracted position by heating the clamp right to a selected high temperature causing a phase change in the clamp ring.

7. The method of claim 6, wherein the selected high temperature is 165° C.

8. The method of claim 1, wherein chilling the clamp ring comprises cooling the clamp ring to a temperature of −120° C.

* * * * *